US005715986A

United States Patent [19]

Sauer

[11] Patent Number: 5,715,986

[45] Date of Patent: Feb. 10, 1998

[54] DRIVING TOOL FOR FASTENER ELEMENTS

[75] Inventor: Marcus Sauer, Bad Schwartau, Germany

[73] Assignee: Joh. Friedrich Behrens AG, Ahrensburg, Germany

[21] Appl. No.: 576,701

[22] Filed: Dec. 21, 1995

[30] Foreign Application Priority Data

Jan. 4, 1995 [DE] Germany ..... 295 00 073.2

[51] Int. Cl.[6] ..... B25C 1/04

[52] U.S. Cl. ..... 227/130

[58] Field of Search ..... 227/8, 130

[56] References Cited

U.S. PATENT DOCUMENTS

| | | | |
|---|---|---|---|
| 4,609,135 | 9/1986 | Elliesen . | |
| 4,932,480 | 6/1990 | Golsch | 227/130 |
| 5,110,030 | 5/1992 | Tanji . | |
| 5,259,465 | 11/1993 | Mukoyama | 227/130 |
| 5,432,307 | 7/1995 | Maurer . | |
| 5,476,205 | 12/1995 | Canlas et al. | 227/130 |
| 5,485,946 | 1/1996 | Jankel | 227/130 |
| 5,495,973 | 3/1996 | Ishizawa et al. | 227/130 |

FOREIGN PATENT DOCUMENTS

| | | |
|---|---|---|
| 28 27 279 C2 | 1/1980 | Germany . |
| 31 19 956 C2 | 12/1982 | Germany . |
| 31 52 497 A1 | 2/1983 | Germany . |
| 38 02 749 A1 | 8/1989 | Germany . |
| 93 05 760.1 | 7/1993 | Germany . |
| 42 39 156 A1 | 5/1994 | Germany . |

*Primary Examiner*—Scott A. Smith

*Attorney, Agent, or Firm*—Vidas, Arrett & Steinkraus, P.A.

[57] ABSTRACT

The invention relates to a driving tool for fastener elements, comprising a casing (1), a working cylinder (3) located in the said casing, and a main valve coaxially mounted atop the said working cylinder, the said main valve comprising a valve chamber (22) located in the said casing (1) and closed by a cap (24), the said main valve further comprising a valve piston (25) which is sealingly and slidably guided in the said valve chamber (22), wherein the valve piston has a lower position in which an inlet passage connected to a source of compressed air is closed with respect to the upper working chamber of the said working cylinder and which valve piston has an upper position in which an outlet passage (43,47,48) which is connected to the working chamber via a throughbore (29,30) of the valve piston is closed by sealingly engaging a valve seat element (34), wherein the valve piston further includes a lower surface area which is continuously subjected to the pressure of the source of compressed air and a further upper surface area which is selectively subjected to atmosphere or the pressure of the source of compressed air by a control valve (15,16,17), wherein the outlet passage (20,30,43,47,48) includes at least an opening (49) at the periphery (46) of the cap (24) that the cap supports a rotatably arranged aperture ring (51) having at least an outlet opening (54) cooperating with the said passage opening, that a peripheral connecting passage (47) extends between the cap and the aperture ring connecting a passage opening and the outlet opening and that the aperture ring (51) is sealingly clamped between the cap (24) and the said casing (1).

14 Claims, 6 Drawing Sheets

DRIVING TOOL FOR FASTENER ELEMENTS

FIELD OF THE INVENTION

The present invention relates to a driving tool for ejecting fastener elements.

BACKGROUND OF THE INVENTION

Driving tools of this type include a nose portion having an ejecting channel through which a fastener element can be ejected. The ejecting channel is supplied with fastener elements fed from a sidewardly positioned magazine. A driving plunger reciprocates in a transversal direction with respect to the supply opening, said plunger moving a fastener element to be ejected out from the nose portion. The plunger is secured to an operating piston which is slidably arranged in a working cylinder. A cylinder chamber atop the piston becomes filled with compressed air when performing a driving operation. The chamber is vented for returning the piston to its initial position. In addition, a cylinder chamber below the working piston may be filled with compressed air for driving the piston back.

Valve means control the compressed air in the upper working chamber of the cylinder. For smaller tool sizes, so-called "parallel valves" are known which are arranged in parallel to the working piston and which are directly associated to a triggering switch. The valve means is connected to the working chamber through narrow passages such that the efficiency is relatively low. For a parallel valve type tool the casing may include a screwing cap to sealingly close the working chamber. The air displaced by the returning motion of the working piston is passed out through an exhaust which is disposed in the area of the tool handle thus not affecting an operator. Driving tools of some other type are provided with so-called "head valves", i.e. a valve means is directly arranged atop the working cylinder. When the valve means is in the opening position, larger passage dimensions between the working cylinder and the source of compressed air are released resulting in a substantially improved efficiency of the driving operation.

Conventionally a main valve is provided above the cylinder. A valve chamber of the main valve houses a valve piston which when being in a lower position closes the communication between an inlet passage connected to a compressed air source and the upper working chamber of the working cylinder. In an upper position, the valve piston closes an outlet passage which is connected via a throughbore in the valve piston to the working chamber. For moving the valve piston between the lower and upper position, it has a lower surface which is constantly subjected to the pressure of the compressed air source. Furthermore, the piston includes an upper surface which can be selectively subjected to atmospheric pressure, or the pressure of the compressed air source by using a control valve. The control valve is positioned adjacent the valve piston in most cases and can be operated by the trigger via a valve rod extending through the casing. However, there are driving tools utilizing a control valve which is connected via an extended control passage to the main valve and thus the valve is directly positioned adjacent the trigger.

The casing cap of driving tools of this type is located above the main valve. The cap is screwed to the casing and is sealed with respect thereto. The cap includes a valve seat element which closes the throughbore of the valve piston in its upper position, thus closing the outlet passage. Then compressed air may flow through the inlet passage into the working chamber driving the working cylinder downwards. The outlet passage extends from the valve seat element to an outlet opening located at the external side of the cap. In the lower position of the valve piston the source of compressed air is shut off the working chamber and the air displaced by the returning working piston is passed through the outlet passage to outside. The exhaust air flowing out of the cap may irritate an operator, as it is possible in certain working positions that the exhaust fully blows towards the operator's face. Therefore, caps have become known which have been provided with externally arranged air guiding means to improve the outflow of air.

The previous head valve type tools are somewhat expensive based on forming the cap in a metal or plastic material die, sealing the cap with respect to the casing and possibly providing air guiding means.

Accordingly, it is the object of the present invention to provide a driving tool for fastening elements of the type referred to which has a reduced expenditure and provides for an improved outflow of the exhaust air.

SUMMARY OF THE INVENTION

The driving tool according to the invention comprises an outlet passage including at least a passage opening located at the periphery of the cap. A rotatable aperture ring having at least an outlet opening which is associated to the passage opening is arranged at the outer surface of the cap. A connecting passage communicating a passage opening and the outlet opening extends peripherally between the cap and the aperture ring. Furthermore, the aperture ring is sealingly clamped between the cap and the casing. By rotating the aperture ring, the outlet opening can be adjusted to a variety of directions. Depending on how the tool is used, the operator may thus conveniently adjust the outlet opening so that he is not irritated by the exhaust air. In addition, the aperture ring provides for sealing the cap and the casing. In contrast to the previous design a sealing element which is separate with respect to the air guide means is not required. Furthermore, the clamping seat of the aperture ring provides for fixing it to the tool, not requiring any additional connecting elements.

Preferably, the outlet passage extends through at least a radial exhaust bore in the cap to the channel opening located at the outer end. The connecting passage may include a groove at the periphery of the cap. A plurality of passage openings may open into the groove. In order to provide for an outflow of air substantially free of noise and obstruction, the outlet opening may be slot-shaped extending along a peripheral portion of the aperture ring. In addition, the outlet opening may cooperate with an air guide surface of the aperture ring to orient the exhaust air preferably away from the top side of the tool which often faces towards the operator.

Preferably, the aperture ring has a L-shaped cross-section including a vertical leg covering the periphery of the cap and having a horizontal leg which is arranged between facing sealing surfaces of the cap and the casing. By clamping the horizontal leg, the seal between the cap and the casing is provided. Clamping forces are considered to be sufficient even when allowing a rotation of the aperture ring.

The cap may be made as a flanged cap which is secured to the casing using a plurality of screws. Then the aperture ring may be located outside the circle of screws. Preferably, the cap, however, is secured to the casing by means of a central threading. This facilitates an assembly free of tilting as well as adjusting the clamping force acting on the aperture ring. Furthermore, the cap may be made solid, i.e. to be used as a hammer head for a finishing work. This particular tool function is favourably affected by the form-ing of the air guide means. The cap does not need to be formed as a metallic or plastic material molding piece, which is expensive, but can be made as a somewhat cheap turned steel member.

Preferably, the threading includes an outer thread provided on the hollow cylindrical cap flange of the cap and an inner thread provided on the upper edge of the valve chamber. Then a control passage of the control valve may open into the valve chamber below the cap. Preferably, the control passage includes a connecting portion to the valve chamber which becomes accessible from outwardly when removing the cap in a linear motion. Furthermore, it is prefered that the control valve or the control passage has a blind bore which extends from the lower side of the casing.

The valve piston may seal with respect to a bore of the casing so that the need of providing a shoulder on the valve piston or an annular valve seal ring may be eliminated. The shoulder is rather formed the casing. Accordingly, the main valve member can be manufactured by using a simple tool. This avoids burrs in the groove provided for the sealing ring. Preferred embodiments of the control passage or, respectively, the control valve avoid providing a further opening at the upper side of the casing such that a terminal portion is obtained by the threadable cap.

Preferably, the valve piston of the main valve includes a piston extension sealingly extending through a bushing of the cap and sealingly engaging the valve seat element in its upper position. The bushing may be outwardly sealingly held in the cap. The upper side of the bushing may be provided with a hollow cylindrical flange including radially extending passage portions of the exhaust passage. The valve seat element may be arranged in a blind bore of the cap. Then the cap including the bushing or the valve seat element may be threadably removed from the casing, whereas the valve piston is maintained in the valve chamber.

BRIEF DESCRIPTION OF THE DRAWINGS

Further details and benefits of the present invention will become apparent from the following description of preferred embodiments with reference to the drawings attached, which show.

DETAILED DESCRIPTION OF THE INVENTION

Figure 1:
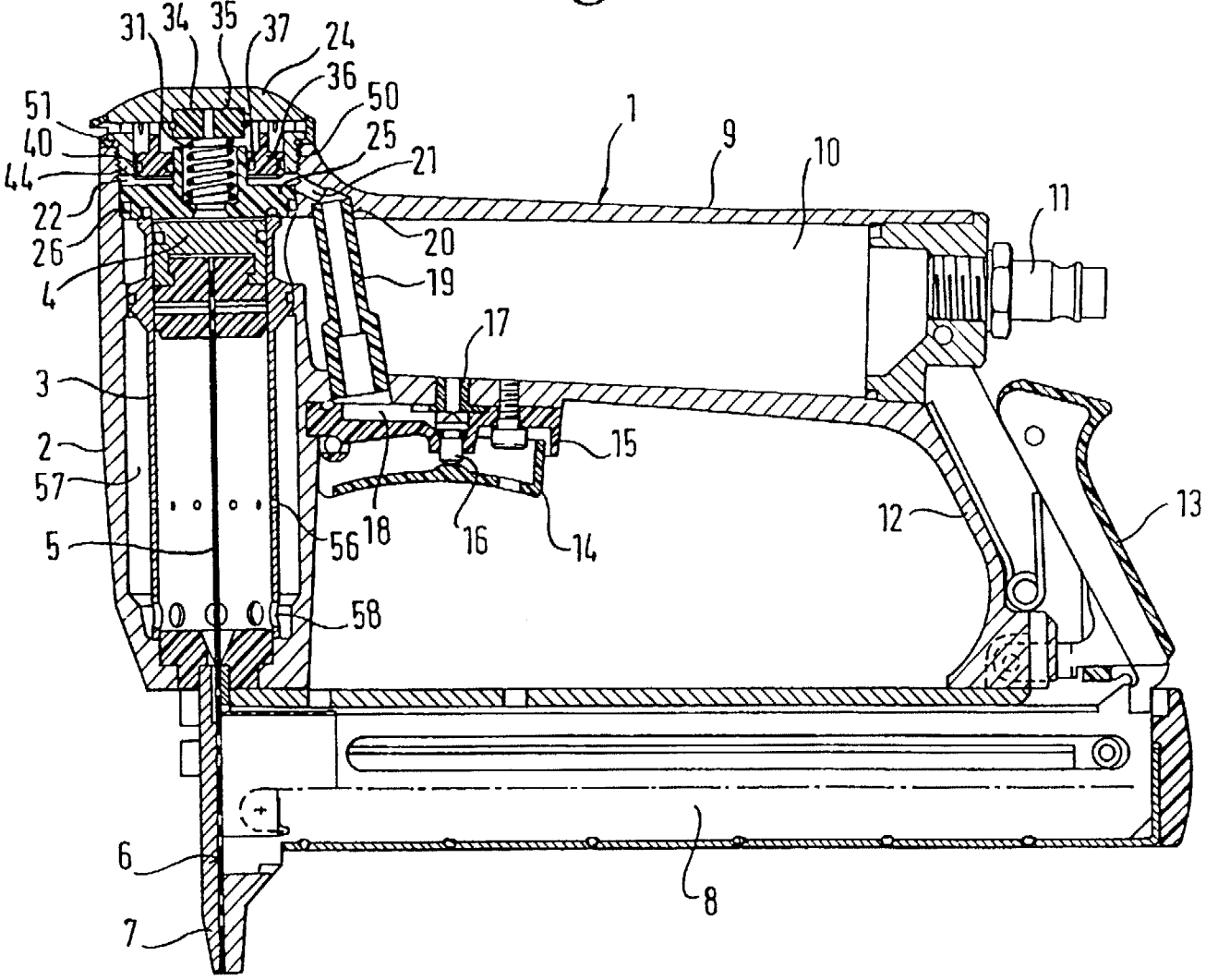
FIG. 1 a section of a driving tool including a centrally threaded cap.
Figure 2:
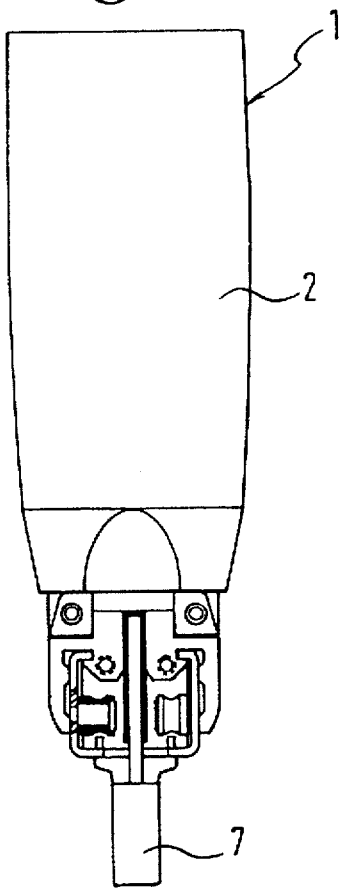
FIG. 2 a front face of the driving tool.

FIGS. 1 and 2 show a driving tool comprising a casing 1 and a head portion 2 including a working cylinder 3, in which a working piston 4 is slidably arranged. The working piston 4 is secured to a driving plunger 5 which is slidably guided in an ejecting channel 6 of a nose portion 7. A magazine 8 containing fastener elements arranged in a linear row is attached sidewards of the nose portion 7. The magazine communicates with the ejecting channel 6 through a supply opening.

The casing 1 is further provided with a handle 9 including a hollow space 10 defining a reservoir of compressed air which space can be connected through a fitting 11 to a source of compressed air. The rear end of the handle 9 is connected to the magazine 8 through a bridge 12. The bridge supports a lever 13 functioning to open and to close the magazine 8 when fastener elements have to be refilled.

A triggering lever 14 is mounted to a control valve support 15 arranged at the lower side of the handle 9 adjacent the head portion 2. The control valve support 15 houses a triggering pin 16 having a cylindrical portion engaging the lever 14 and having a conical portion concentrically facing a sealing bushing 17 fixed to the casing 1 and communicating with the reservoir 10. In the position shown the conical portion of the triggering pin 16 opens the bore of the sealing bushing 17 to connect a hollow space 18 defined by the control valve support 15 to the reservoir of compressed air. When actuating the triggering lever 14 by pivoting upwards the conical portion enters the opening of the bushing 17 to close off the passage. Still further, an O-ring seal (not shown) provided in a groove between the conical portion and the cylindrical portion is lifted from a sealed seat of the control valve support 15 to open a passage of the hollow space 18 to the atmosphere in the area of the cylindrical portion 16.

The hollow space 18 is connected to a control passage comprising a tube 19 extending through the reservoir 10 which tube fits into a blind bore 20 which has been produced from below the casing. The control passage includes a bore 21 communicating with the blind bore 20 opening into a valve space 22 which is located above the working cylinder 3 and which is closed by a cap 24 from above.

Figure 3A:
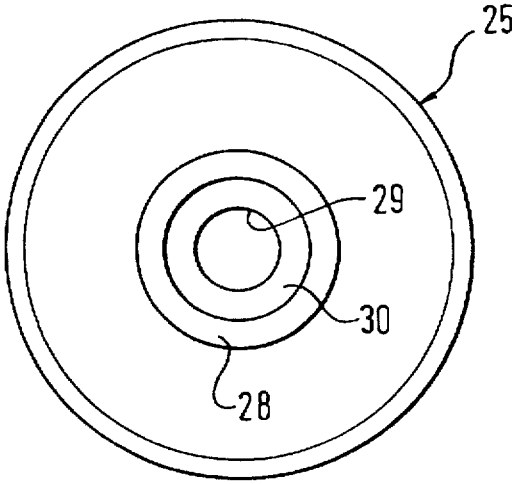
FIG. 3 a plane view (a) and a section (b) of a valve piston of the driving tool in a larger scale.
Figure 3B:
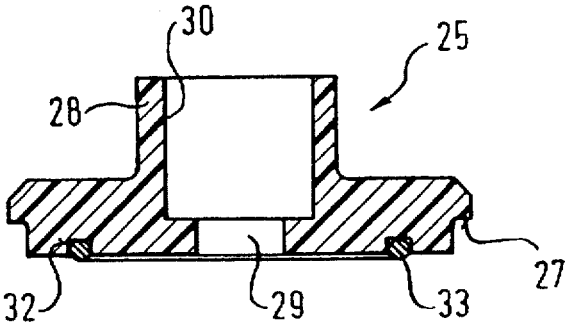
Figure 4A:
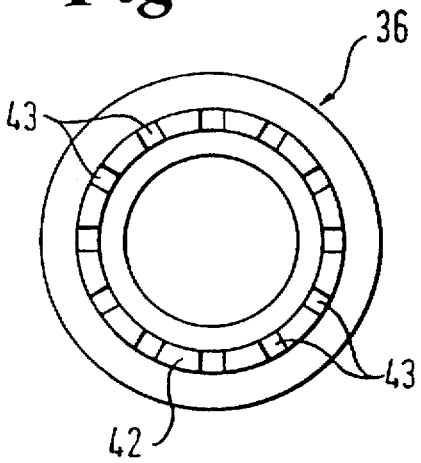
FIG. 4 a plane view (a), a side view (b), a bottom view (c) and a section (d) of a bushing of the driving tool in an enlarged scale.
Figure 4B:
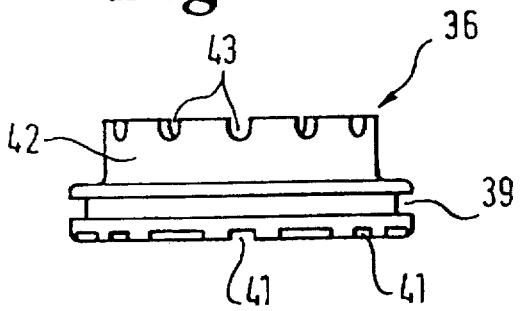
Figure 4C:
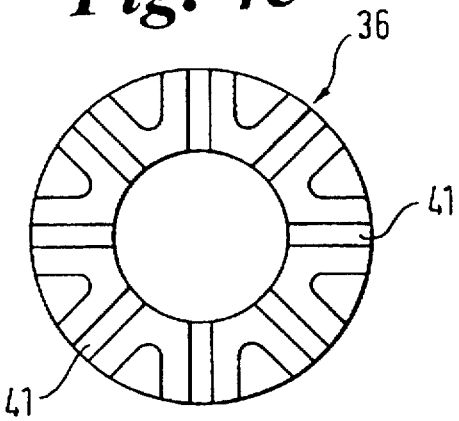
Figure 4D:
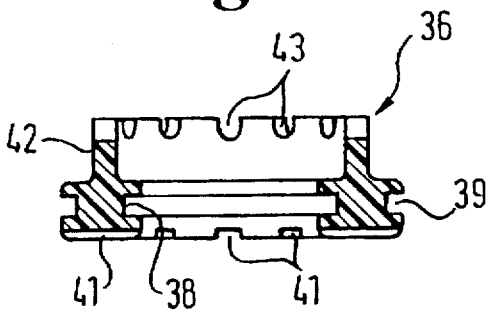

The valve chamber 22 houses a valve piston 25 which outer periphery is provided with an O-seal ring 26. As FIG. 3 shows to some detail, the valve piston 25 includes an outer shoulder 27 receiving the O-ring 26. From the upper surface of the valve piston 25 a cylindrical projection 28 extends. The valve piston has a central throughbore 29 extending through the projection 28. The upper portion 30 of the throughbore 29 is enlarged receiving a helical spring 31.

The lower face of the valve piston 25 is provided with an annular groove 32 receiving an O-seal ring 33 slidely projecting beyond the lower surface of the valve piston.

In the position shown in FIG. 1 the valve piston 25 sealingly engages the upper edge of the working cylinder 3 by means of the lower side of the O-seal ring 33. The helical spring 31 engages the lower side of a valve seat element 34 which is received in a blind bore 35 of the cap 24.

The projection 28 of the piston is guided in a bushing 36 including an O-seal ring 37 for sealing with respect to the projection. As FIG. 4 more clearly shows, the bushing 36 is provided with an internal annular groove 38 receiving the O-seal ring. An outer annular groove 39 receiving a further O-seal ring 40 provides for an external seal. The lower side of the bushing 36 includes radially extending grooves 41. The upper side of the bushing 36 comprises a hollow cylindrical extension 42 which is upwards provided with radially extending exhaust grooves 43.

Figure 5A:
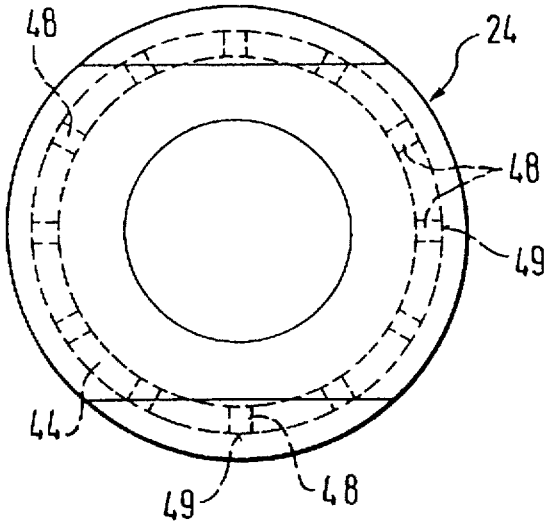
FIG. 5 a plane view (a) and a section (b) of a cap of the driving tool in an enlarged scale.
Figure 5B:
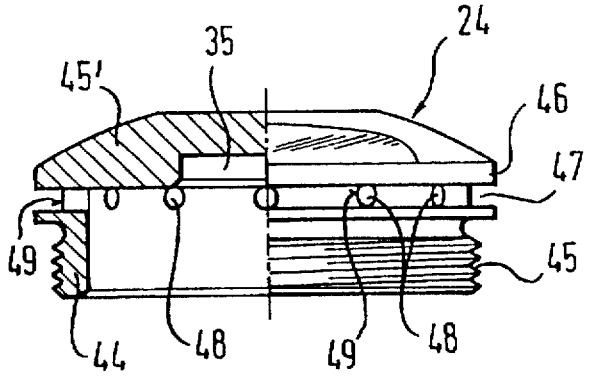

As shown in FIG. 1 the upper edge of the bushing 36 engages the lower side of the cap 24, wherein the exhaust grooves 43 allow an air flow between the inner and outer side of the bushing. On the outer side an O-seal ring 40 of the bushing 36 engages a hollow cylindrical extension 44 of the cap 24. FIG. 5 more clearly shows that the extension 44 of the cap carries an outer thread 45. The upper portion 45' of the cap 24 is defined by a flat frustroconical portion 45'. Between the frustroconical portion 45' and the extension 44 there is a short cylinder portion 46 which is provided with an outer annular groove 47. The cylindrical portion 46 is provided with a number of radial exhaust bores 48 which are open towards the inner side of the cap and further open at 49 to the annular groove 47. The cap 24 is a solid turned part made from metal.

FIG. 1 shows that the hollow cylindrical extension 44 of the cap 24 is threaded into the head portion 2 of the casing. To this end the upper edge of the valve chamber 22 is provided with an inner thread 50 cooperating with an outer thread 45.

Figure 6A:
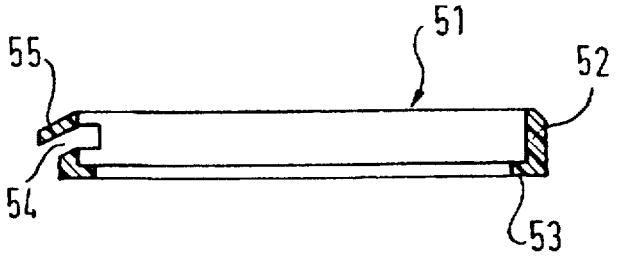
FIG. 6 a section (a), a plane view (b) and a side view (c) of an aperture ring of the driving tool in an enlarged scale and FIG. 7 a plane view (a) and a section (b) of a cap including an aperture ring which can be fixes flange-like by means of screws to a casing.
Figure 6B:
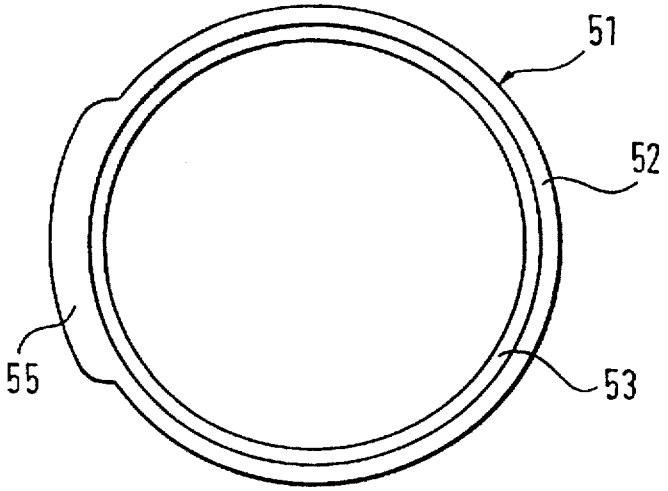
Figure 6C:
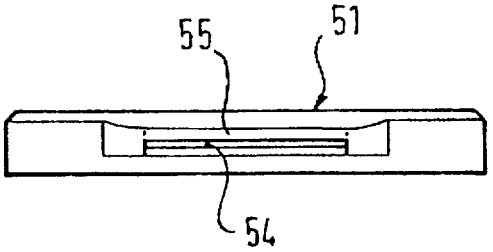

The cap 24 supports an aperture ring 51 which is arranged at the outer periphery of the cylindrical portion 46. FIG. 6 shows the aperture ring 51 including a leg 52 covering the annular groove 47 and a leg 53 engaging the cylindrical portion 46 from below. The leg 43 is clamped between the cap 24 and the upper edge of the head portion 2 for sealing off the cap 24 with respect to the casing 1. The leg 52 has a slot-shaped exhaust opening 54 extending along a portion of its periphery (approximately 45°). At the upper side of the exhaust opening 55 the leg 51 is provided with an air guide fin 55 which is inclined with respect to the leg 52 under an acute angle. The aperture ring 51 can be rotated, wherein the air guide fin 55 may be engaged by the fingers. Thus, the position of the exhaust opening 54 with respect to the annular groove 47 can be varied.

It should be still pointed out that the radial bore 56 of the working cylinder 3 connects the working volume to a piston return chamber 57 surrounding the working cylinder. The piston return chamber 57 is connected through further radial bores 58 of larger diameter than the radial bores 56 located near the nose portion 7 to the working chamber.

The driving tool functions as follows: In the initial position shown in FIG. 1 the reservoir 10 of compressed air is connected through the hollow space 18, the tube 20 and the passage 21 to the valve chamber 22. The upper side of the valve piston 25 is thus subjected to compressed air from the reservoir 10. In addition the region projecting beyond the working cylinder 3 at the lower side of the valve piston 25 is subjected to compressed air. As the pressure acting on the upper surface of the valve piston 25 in addition to the helical spring 31 is higher than the pressure acting on the lower surface, the valve piston is sealingly urged towards the upper edge of the working cylinder 3. The working chamber atop the working piston 4 is connected through the throughbore 29 of the valve piston to the inner space of the bushing 26 and through the exhaust grooves 43 to the inner space of the extension 44. It is further connected through atmosphere via the exhaust bores 48 and the annular groove 47 in the cap 24 as well as the exhaust opening 54 of the aperture ring 51.

When actuating the triggering lever 14, the hollow space 18 and thus the valve chamber 22 are connected to atmosphere. Accordingly, the compressed air acts only still to the lower surface of the valve piston 25 which is thus displaced against the force of the helical spring 31 to its upper opening position in which the upper edge of the piston extension 28 sealingly engages the valve seat element 34. Thereby the communication of the working chamber to atmosphere is shut off. Furthermore, the upward motion of the valve piston 25 makes it possible that compressed air flows from the reservoir 10 across the upper edge of the working cylinder 3 into the working chamber so that the piston 4 is blown downwardly. Accordingly, a fastener element fed in from the magazine 8 is ejected by the ejecting plunger 5 through the nose portion 7.

After releasing the triggering lever 14 the latter returns into its initial position shown in FIG. 1. The upper area of the valve piston 25 is thus again subjected to compressed air. The grooves 41 of the bushing 36 provide for a distribution of compressed air up to the piston extension 28. Therefore, the valve piston 25 returns to its lower closing position as illustrated and the communication of the working chamber to atmosphere is opened again. In the lowest position of the piston, the compressed air has passed through radial bores 56 into the piston return chamber 57. This air flows through the further radial bores 58 into the working chamber below the working piston 4 which upper chamber has been vented to return the piston to the initial position shown in FIG. 1.

A particular advantage of this driving tool resides in the fact that the cap 24 can be easily screwed on and off, wherein the valve seat element 34 and the sealingly clamped bushing 36 will be carried with it. Furthermore, the solid turned part may be used as an impact surface for finishing works. In addition, by adjusting the outlet opening 54 the aperture ring 51 allows to direct the ejection of air displaced by the piston moving upwards into a direction which is convenient to the user. In addition, the aperture ring 51 serves to seal the cap 24 with respect to the casing 1.

Figure 7A:
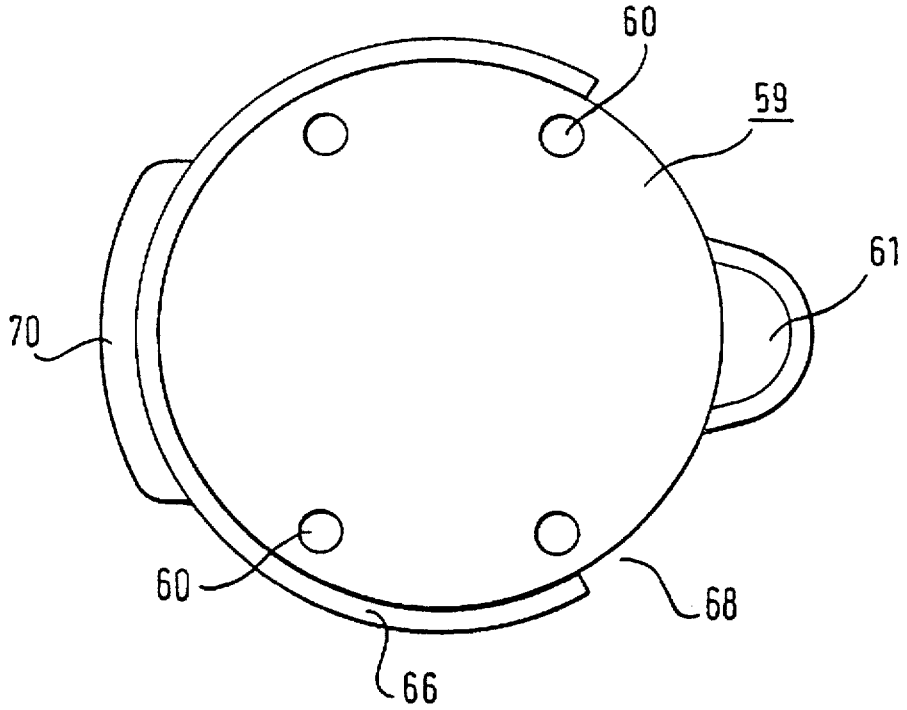
Figure 7B:
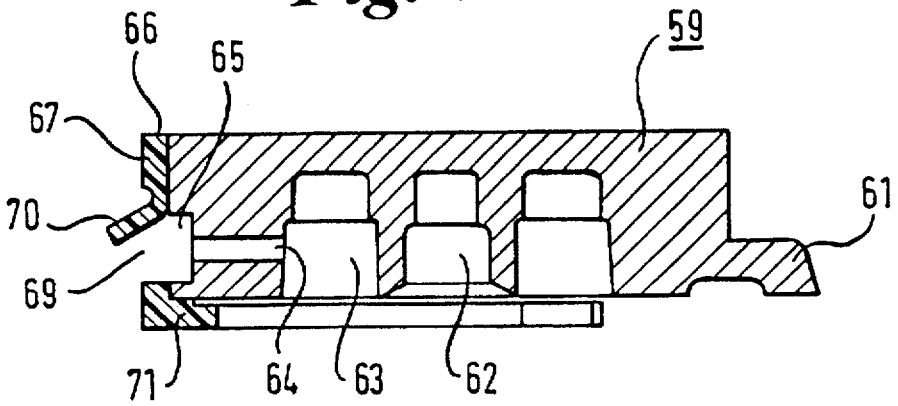

According to FIG. 7 showing an alternative embodiment of the cap 59, the latter includes a plurality of circularly arranged throughbores 60 for receiving screws to secure the cap in a flange-like fashion atop a main valve to a casing. The cap 59 carries a sidewardly projecting nose 51 for sealing a bore of the control valve or the control passage opening ajacent the main valve chamber. The lower side of the cap 59 is provided with a central blind bore 62 cooperating with the valve seat element and a surrounding groove 63 receiving a sound absorber and providing for ejecting the air. Radial ejecting bores 64 open from the groove 63 towards of the periphery of the cap 49, from where they open into an annular groove 65.

An aperture ring 66 having a substantially L-shaped cross-section is attached to the periphery of the cap 59. The vertical leg 67 is recessed at 68 such that the aperture ring is adjustable along the cylindrical periphery of the cap 59 until it engages the nose 61.

The aperture ring 66 further includes a slot-shaped outlet opening 69 extending along a portion of its periphery. An air guiding fin 70 sloped downwardly is provided above the outlet opening 69.

The horizontal leg 71 of the aperture ring 66 engages the lower face of the cap 59 from below so that it is clamped between the lower face and the upper edge of the casing. The horizontal leg 71 extends outside the throughbores 60 which thus do not interfer with rotating the aperture ring 66.

The annular groove 65 extends along the periphery of the cap 59 only within the rotating range of the vertical leg 67 of the aperture ring 66. Exhaust air entering the annular groove 65 from the groove 63 via the ejecting bores 64 can thus only flow out through the outlet opening 69 and is thus ejected as determined by the rotational position of the aperture ring 66.

I claim:

1. A driving tool for fastener elements, comprising a casing (1), a working cylinder (3) located in said casing, and a main valve coaxially mounted atop said working cylinder, said main valve comprising a valve chamber (22) located in said casing (1) and closed by a cap means (24), said main valve further comprising a valve piston (25) which is sealingly and slidably guided in said valve chamber (22), wherein the valve piston has a lower position in which an inlet passage connected to a source of compressed air is closed with respect to the upper working chamber of said working cylinder and which valve piston has an upper position in which an outlet passage (43,47,48) which is connected to the working chamber via a throughbore (29,30) of the valve piston is closed by sealingly engaging a valve seat element (34), wherein the valve piston further includes a lower surface which is continuously subjected to the pressure of the source of compressed air and a further upper surface which is selectively subjected to atmosphere or the pressure of the source of compressed air by means of a control valve (15,16,17), characterized in that the outlet passage (20,30,43,47,48) includes at least an opening (49) at the periphery (46) of the cap means (24) that the cap means supports a rotatably arranged aperture ring (51) having at least an outlet opening (54) cooperating with said at least one passage opening, that a peripheral connecting passage (47) extends between the cap means and the aperture ring connecting a passage opening and the outlet opening and that the aperture ring (51) is sealingly clamped between the cap means (24) and said casing (1).

2. The driving tool of claim 1, wherein the outlet passage in the cap means (24) includes at least a radial ejecting bore (48) with the passage opening (49) located at its outer end.

3. The driving tool of claim 1 wherein the connecting passage includes an annular groove (47) along the periphery (46) of the cap means (24).

4. The driving tool of claim 1, wherein the outlet opening (54) extends slot-shaped along a peripheral portion of the aperture ring (51).

5. The driving tool of claim 1, wherein an air guiding fin (55) of the aperture ring (51) is associated to the outlet opening (54).

6. The driving tool of claim 1, wherein the aperture ring (51) has a L-shaped cross-section, wherein the vertical leg (52) is located at the periphery (46) of the cap means (24) and the horizontal leg (53) is located between the facing sealing surfaces of the cap means (24) and the casing (1).

7. The driving tool of claim 1, wherein the cap means (24) includes a central threaded connection (45,50) with respect to the casing (1).

8. The driving tool of claim 1, wherein the cap means (24) is defined by a turned steel part.

9. The driving tool of claim 7, wherein the threaded connection includes an outer thread (45) provided on a hollow cylindrical extension (44) of the cap means (24) and an inner thread (50) provided on the upper edge of the valve chamber (22).

10. The driving tool of claim 1, wherein a control passage (19,21) of the control valve opens into the valve chamber (22) below the cap means (24).

11. The driving tool of claim 1, wherein the control passage comprises a portion (19) including a blind bore (20) being worked from below the casing and/or a connecting portion (21) which is accessible by a linear motion when the cap means is removed.

12. The driving tool of claim 1, wherein the valve piston (25) includes a hollow cylindrical extension (28) at its upper surface through which the throughbore (29,30) of the valve piston extends which is sealingly and slidably guided in a bushing (36) of the cap means (24) and which sealingly engages the valve seat element (34) in the upper position.

13. The driving tool of claim 12, wherein the bushing (36) is externally sealingly held in the cap means (24).

14. The driving tool of claim 13, wherein the bushing (36) includes a hollow cylindrical extension (42) at the upper surface extending towards the lower side of the cap means which extension includes a radial passage portion (43) of the outlet passage.

* * * * *